US011413859B1

(12) United States Patent
Fleischer et al.

(10) Patent No.: US 11,413,859 B1
(45) Date of Patent: Aug. 16, 2022

(54) DUCTOR ROLL ASSEMBLY, INK STATION ASSEMBLY AND CAN DECORATOR EMPLOYING SAME

(71) Applicant: Stolle Machinery Company, LLC, Centennial, CO (US)

(72) Inventors: Karl Scott Fleischer, Denver, CO (US); Bryon Lee Kajfosz, Littleton, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 17/174,465

(22) Filed: Feb. 12, 2021

(51) Int. Cl.

| | |
|---|---|
| ***B41F 31/14*** | (2006.01) |
| ***B41F 31/10*** | (2006.01) |
| *B41F 16/00* | (2006.01) |
| *B41F 17/22* | (2006.01) |

(52) U.S. Cl.
CPC ..... *B41F 31/14* (2013.01); *B41F 16/00* (2013.01); *B41F 17/22* (2013.01); *B41F 31/10* (2013.01); *B41P 2217/50* (2013.01); *B41P 2231/10* (2013.01)

(58) Field of Classification Search
CPC ..... B41P 2231/10; B41F 31/10; B41F 31/12; B41F 31/14
See application file for complete search history.

(56) References Cited

U.S. PATENT DOCUMENTS

| | | | | |
|---|---|---|---|---|
| 3,417,692 | A * | 12/1968 | Brodie | B41F 31/14 101/352.13 |
| 5,688,217 | A * | 11/1997 | Izume | B65H 23/048 492/39 |
| 9,446,581 | B2 | 9/2016 | Yamasaki | |
| 2007/0006757 | A1* | 1/2007 | Kusaka | B41F 31/14 101/350.1 |

FOREIGN PATENT DOCUMENTS

| | | | |
|---|---|---|---|
| EP | 1566270 | A1 | 8/2005 |

* cited by examiner

*Primary Examiner* — Leslie J Evanisko
*Assistant Examiner* — Leo T Hinze
(74) *Attorney, Agent, or Firm* — Eckert Seamans Cherin & Mellott, LLC

(57) ABSTRACT

A ductor roll assembly for use in an ink station assembly of a can decorator for communicating ink from a fountain roll to a distributor roll. The ductor roll assembly having a roll portion including an elongated axial member and a plurality of segments selectively disposed on and around the axial member axially adjacent each other for rotation about a rotation axis. The plurality of segments includes: a number of ink transfer segments, each ink transfer segment having an ink transfer surface disposed at a first radial distance from the rotation axis and structured to transfer ink between a corresponding axial portion of a fountain roll and a corresponding axial portion of a distributor roll; and a number of spacer segments having a second outer diameter less than the first outer diameter.

13 Claims, 8 Drawing Sheets

DUCTOR ROLL ASSEMBLY, INK STATION ASSEMBLY AND CAN DECORATOR EMPLOYING SAME

BACKGROUND

Field

The disclosed concept relates generally to machinery and, more particularly, to can decorator machines and methods for decorating cans used in the food and beverage packaging industries. The disclosed concept also relates to ink station assemblies for can decorator machines.

Background Information

High speed continuous motion machines for decorating cans, commonly referred to as can decorator machines or simply can decorators, are generally well known.

FIGS. 1-3 show a can decorator 100 of the type disclosed, for example, in commonly assigned U.S. patent application Ser. No. 17/114,730, the contents of which are incorporated herein by reference. FIG. 1 shows a portion of the can decorator machine 100 including a plurality of ink station assemblies 200 (eight are shown). The can decorator machine 100 is structured to decorate (e.g., apply a desired ink-based image to the exterior of) a plurality of cans 300 (one can 300 is shown in simplified form in phantom line drawing in FIG. 1 for simplicity of illustration). Among other components, the can decorator machine 100, also sometimes referred to simply as a can decorator, includes a blanket 102 having a plurality of image transfer segments 104 (also shown in phantom line drawing in FIG. 3). Preferably, the blanket 102 is structured to transfer an image associated with each image transfer segment 104 to a corresponding one of the cans 300. As previously noted, the can decorator 100 further includes a plurality of ink station assemblies 200. It will be appreciated that, while the can decorator 100 in the example shown and described herein includes eight ink station assemblies 200, that it could alternatively contain any known or suitable alternative number and/or configuration of ink station assemblies (not shown), without departing from the scope of the disclosed concept. It will further be appreciated that, for economy of disclosure and simplicity of illustration, only one of the ink station assemblies 200 will be shown and described in detail herein.

FIGS. 2 and 3 show views of one of the ink station assemblies 200 in greater detail. Specifically, the ink station assembly 200 includes an ink fountain 202 structured to provide a supply of ink 400 (shown in phantom line drawing in simplified form in FIG. 2). A fountain roll 204 receives the ink 400 from the ink fountain 202. An ink key system having a plurality of adjustable fountain keys 205 positioned side-by-side along the interface between the ink fountain 202 and the fountain roll 204 regulates the amount of ink 400 passing from the ink fountain 202 to the fountain roll 204. More particularly, each fountain key 205 regulates the amount of ink 400 passing from the ink fountain 202 to a corresponding axial portion of the fountain roll 204. The example illustrated in FIG. 2 includes eight fountain keys 205, however, it is to be appreciated that the quantity of fountain keys 205 may vary depending on the particular application.

The ink station assembly 200 further includes a distributor roll 206 and a ductor roll 208. The ductor roll 208 is cooperable with both the fountain roll 204 and the distributor roll 206 to transfer the ink 400 from the fountain roll 204 to the distributor roll 206. More particularly, the ductor roll 208 pivots on a pair of pivot arms 209 between a first position in which the ductor roll 208 receives the ink 400 from the fountain roll 204 to a second position in which the ductor roll 208 transfers the ink 400 to the distributor roll 206. A number of oscillator rolls 210,212 (two are shown) are further provided as parts of the ink station assembly 200, with each, respectively, having a longitudinal axis 214,216. The oscillator rolls 210,212 are structured to oscillate back and forth along such longitudinal axis 214,216, respectively. The example ink station assembly 200 also includes two transfer rolls 218,220, each of which cooperates with at least one of the oscillator rolls 210,212. A printing plate cylinder 222 includes a printing plate (generally indicated by reference number 224), and cooperates with a number of form rolls 230 to apply the ink 400 to the printing plate 224 and on to the image transfer segments 104 of the blanket 102.

Depending upon the label design being printed by the can decorator 100, one or more of the fountain keys 205 may need to be adjusted such that there is no ink being conveyed to the ink train in a particular non-image area of the label. In order to achieve absolute zero ink in this area, it is necessary for the corresponding ink key 205 to contact the fountain roller 202 and "scrape" all of the ink off of the fountain roller 202 in the area. Such contact results in wear of the fountain key 205, damage to the fountain roller 202 or both. Also, in a remotely actuated ink key system (i.e. servo driven), this results in losing the zero key setting upon which the label recipes are based.

There is, therefore, room for improvement in can decorating machines and methods, and in ink station assemblies.

SUMMARY

These needs and others are met by embodiments of the disclosed concept, which are directed to an ink station assembly for a can decorator machine and an associated method of decorating cans. Among other benefits, the ink station assembly and method employ a single form roll to address ink inconsistencies and issues (e.g., without limitation, ink starvation; ink film thickness; variation of ink film thickness; image ghosting).

As one aspect of the disclosed concept, a ductor roll assembly for use in an ink station assembly of a can decorator for communicating ink from a fountain roll to a distributor roll is provided. The ductor roll assembly includes a roll portion comprising: an elongated axial member; and a plurality of segments selectively disposed on and around the axial member axially adjacent each other for rotation about a rotation axis, wherein the plurality of segments comprises: a number of ink transfer segments, each ink transfer segment having an ink transfer surface disposed at a first radial distance from the rotation axis and structured to transfer ink between a corresponding axial portion of a fountain roll and a corresponding axial portion of a distributor roll; and a number of spacer segments having a second outer diameter less than the first outer diameter.

One or both of: the number of ink transfer segments may comprise a plurality of ink transfer segments, and/or the number of spacer segments may comprise a plurality of spacer segments.

The elongated axial member may comprise a central shaft that is structured to be rotationally coupled to a pair of pivot arms so as to rotate about the rotation axis, and each segment of the plurality of segments may be rotationally fixed with respect to the central shaft.

Each ink transfer segment may comprise a central hub formed form a first material and an outer portion formed from a second material disposed radially outward from, and coupled to, the central hub.

The elongated axial member may comprise a hollow cylinder that is structured to be positioned around, and rotationally coupled to, a central shaft so as to rotate about the rotation axis.

The elongated axial member may comprise a central shaft that is structured to be fixedly coupled to a pair of pivot arms so as to be fixed with respect to the rotation axis, and each ink transfer segment may be rotatably coupled to the central shaft so as to be rotatable about the rotation axis.

The ductor roll assembly may further comprise a pair of pivot arms, wherein: the roll portion is coupled to, and between the pair of pivot arms, and the pair of pivot arms are structured to pivot the roll portion about a pivot axis that is parallel to the rotation axis.

Each pivot arm of the pair of pivot arms may comprise an upper portion and a lower portion, the upper portion being coupled to the roll portion, the lower portion being structured to be coupled to an ink station assembly, and the upper portion being selectively coupled to the lower portion so as to provide for the roll portion and the upper portion to be selectively uncoupled from the lower portion.

As another aspect of the disclosed concept, an ink station assembly for use in a can decorator is provided. The ink station assembly comprises: an ink fountain structured to provide a supply of ink; a fountain roll disposed adjacent the ink fountain and structured to receive the ink from the ink fountain; a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises: an elongated axial member; and a plurality of segments selectively disposed on and around the axial member axially adjacent each other for rotation about a rotation axis, wherein the plurality of segments comprises: a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter.

The ink station assembly may further comprise a plurality of adjustable fountain keys positioned side-by-side along an interface between the ink fountain and the fountain roll, each fountain key being structured to regulate the amount of ink passing from the ink fountain to the fountain roll, wherein each fountain key has a fountain key width that is the same as each of the other fountain keys, and wherein each ink transfer segment has an axial length along the rotation axis that is either the same as, or a multiple of, the fountain key width.

One or both of: the number of ink transfer segments may comprise a plurality of ink transfer segments, and/or the number of spacer segments may comprise a plurality of spacer segments.

The elongated axial member may comprise a central shaft that is structured to be rotationally coupled to a pair of pivot arms so as to rotate about the rotation axis, and each segment of the plurality of segments may be rotationally fixed with respect to the central shaft.

Each ink transfer segment may comprise a central hub formed form a first material and an outer portion formed from a second material disposed radially outward from, and coupled to, the central hub.

The elongated axial member may comprise a hollow cylinder that is structured to be positioned around, and rotationally coupled to, a central shaft so as to rotate about the rotation axis.

The elongated axial member may comprise a central shaft that is structured to be fixedly coupled to a pair of pivot arms so as to be fixed with respect to the rotation axis, and each ink transfer segment may be rotatably coupled to the central shaft so as to be rotatable about the rotation axis.

The ductor roll assembly may further comprise a pair of pivot arms for pivoting the roll portion between the first position and the second position, the roll portion may be coupled to, and between the pair of pivot arms, the pair of pivot arms may be structured to pivot the roll portion about a pivot axis that is parallel to the rotation axis, each pivot arm of the pair of pivot arms may comprise an upper portion and a lower portion, the upper portion may be coupled to the roll portion, the lower portion may be coupled to another portion of the ink station assembly, and the upper portion may be selectively coupled to the lower portion so as to provide for the roll portion and the upper portion to be selectively uncoupled from the lower portion.

As yet another aspect of the disclosed concept, a can decorator for applying an image to a plurality of cans is provided. The can decorator comprises: a number of ink station assemblies, each ink station assembly comprising: an ink fountain structured to provide a supply of ink; a fountain roll disposed adjacent the ink fountain and structured to receive the ink from the ink fountain; a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises: an elongated axial member; and a plurality of segments selectively disposed on and around the axial member axially adjacent each other for rotation about a rotation axis, wherein the plurality of segments comprises: a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter; and a blanket having a plurality of image transfer segments structured to receive ink from each ink station assembly and transferring the ink to the plurality of cans.

The number of ink station assemblies may comprise a plurality of ink station assemblies.

One or both of: the number of ink transfer segments may comprise a plurality of ink transfer segments, and/or the number of spacer segments may comprise a plurality of spacer segments.

The elongated axial member may comprise a central shaft that is structured to be rotationally coupled to a pair of pivot arms so as to rotate about the rotation axis, and each segment of the plurality of segments may be rotationally fixed with respect to the central shaft.

A can decorator machine and method of decorating cans are also disclosed.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are provided for the purpose of illustration and description only and are not intended as a definition of the limits of the concept.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
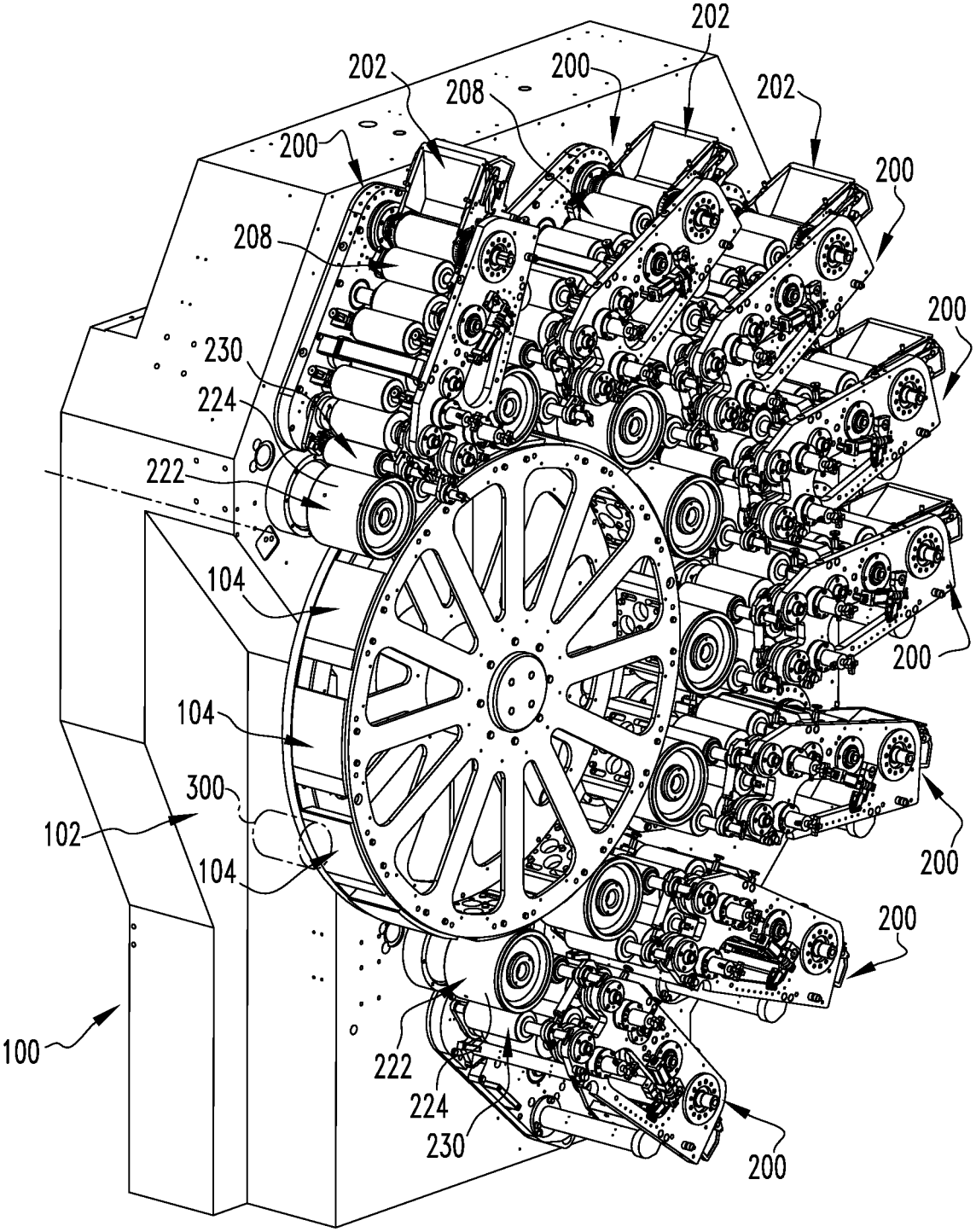
FIG. 1 is an isometric view of a portion of a can decorator machine and ink station assembly therefor.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the term "can" refers to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "ink train" refers to the pathway by which ink is transferred through the ink station assembly and, in particular, from the ink fountain, through the various rolls of the ink station assembly to the printing plate cylinder.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Embodiments of the disclosed concept address problems with conventional ductor rolls and ink stations such as previously discussed by providing arrangements that allow for ink transfer in selected axial regions of a ductor roll while preventing ink transfer in selected other axial regions.

Figure 3:
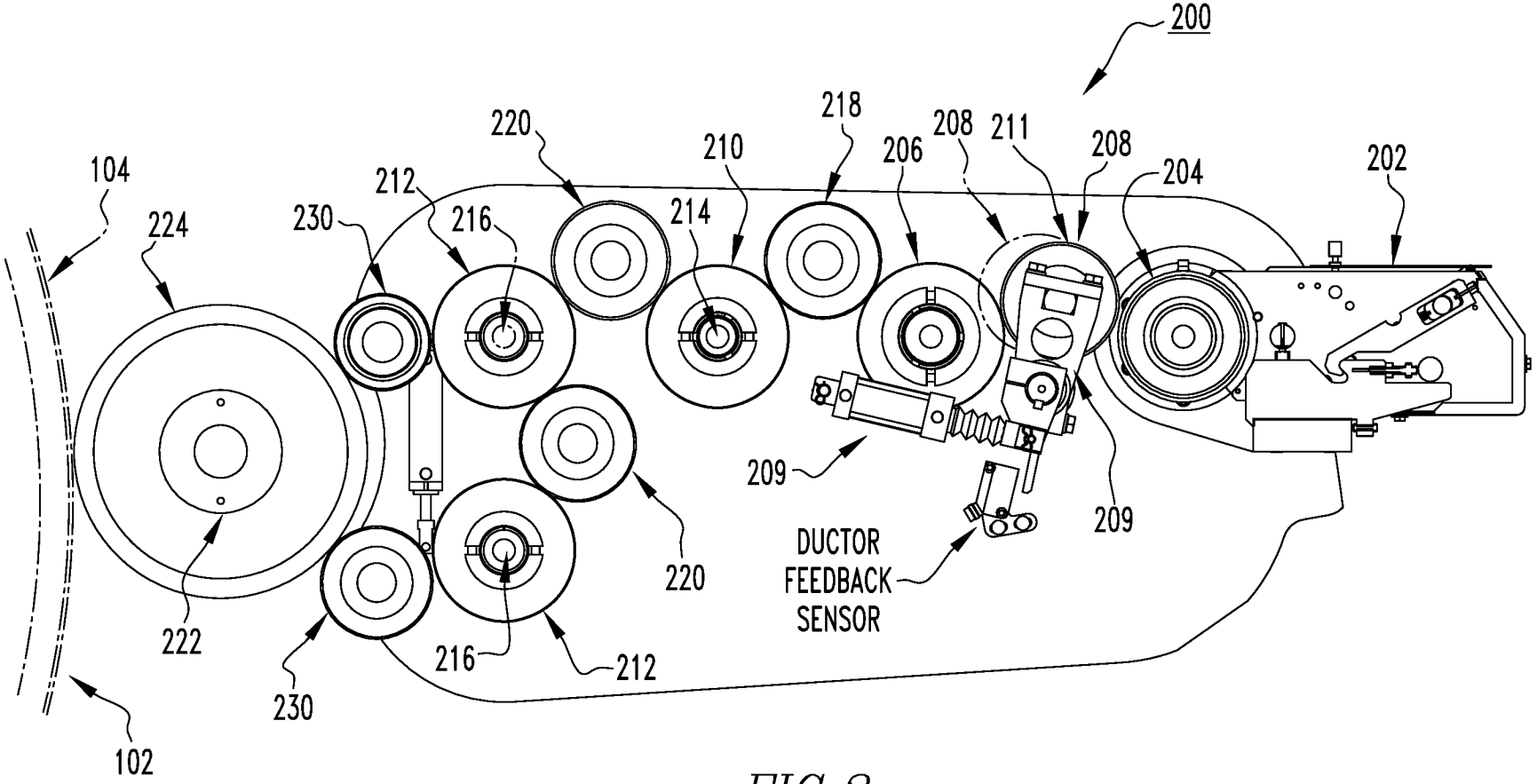
FIG. 3 is a side elevation view of the ink station assembly of FIG. 2 with one of the side plates removed to show hidden structures.
Figure 4:
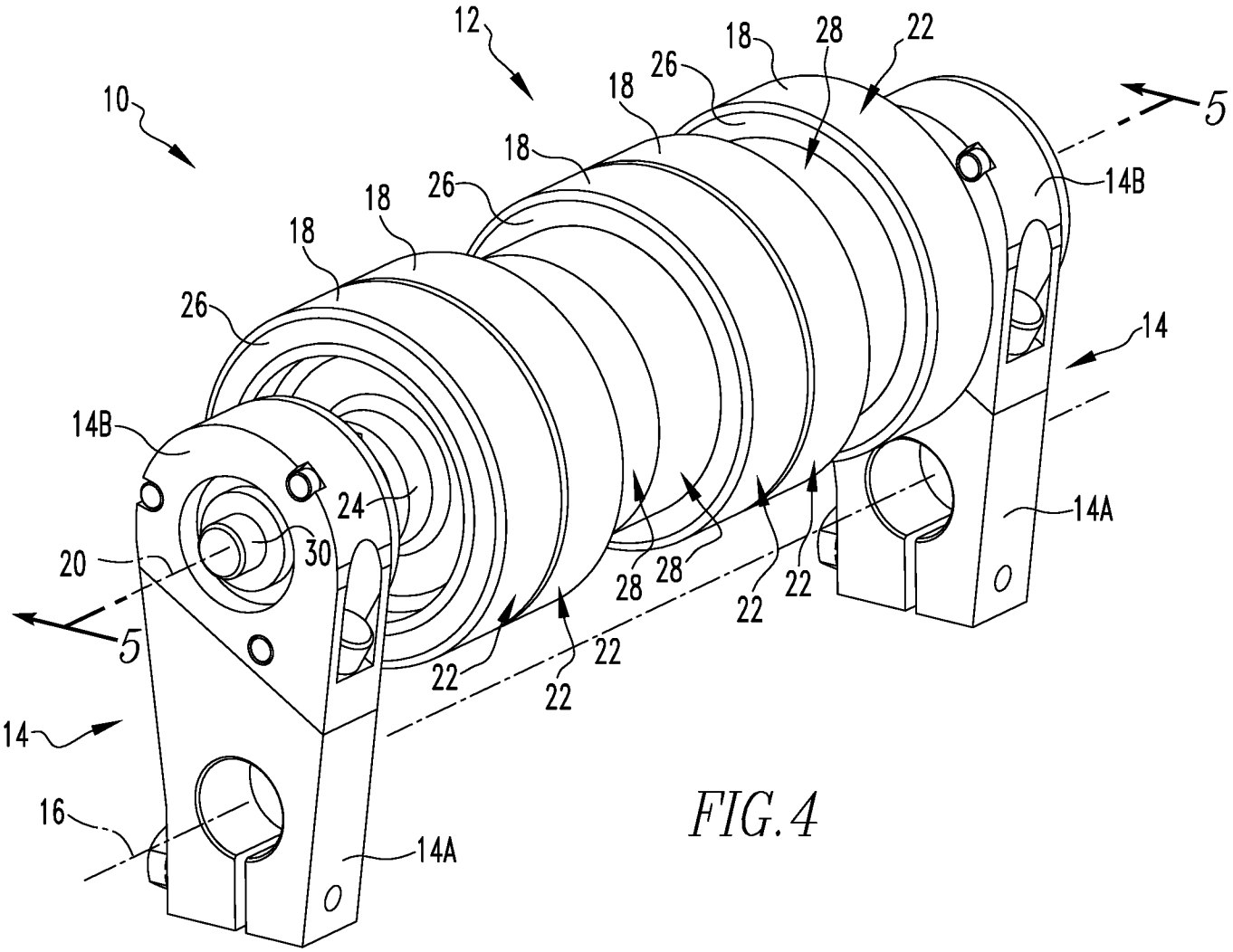
FIG. 4 is a perspective view of a ductor roll assembly in accordance with an example embodiment of the disclosed concept.
Figure 5:
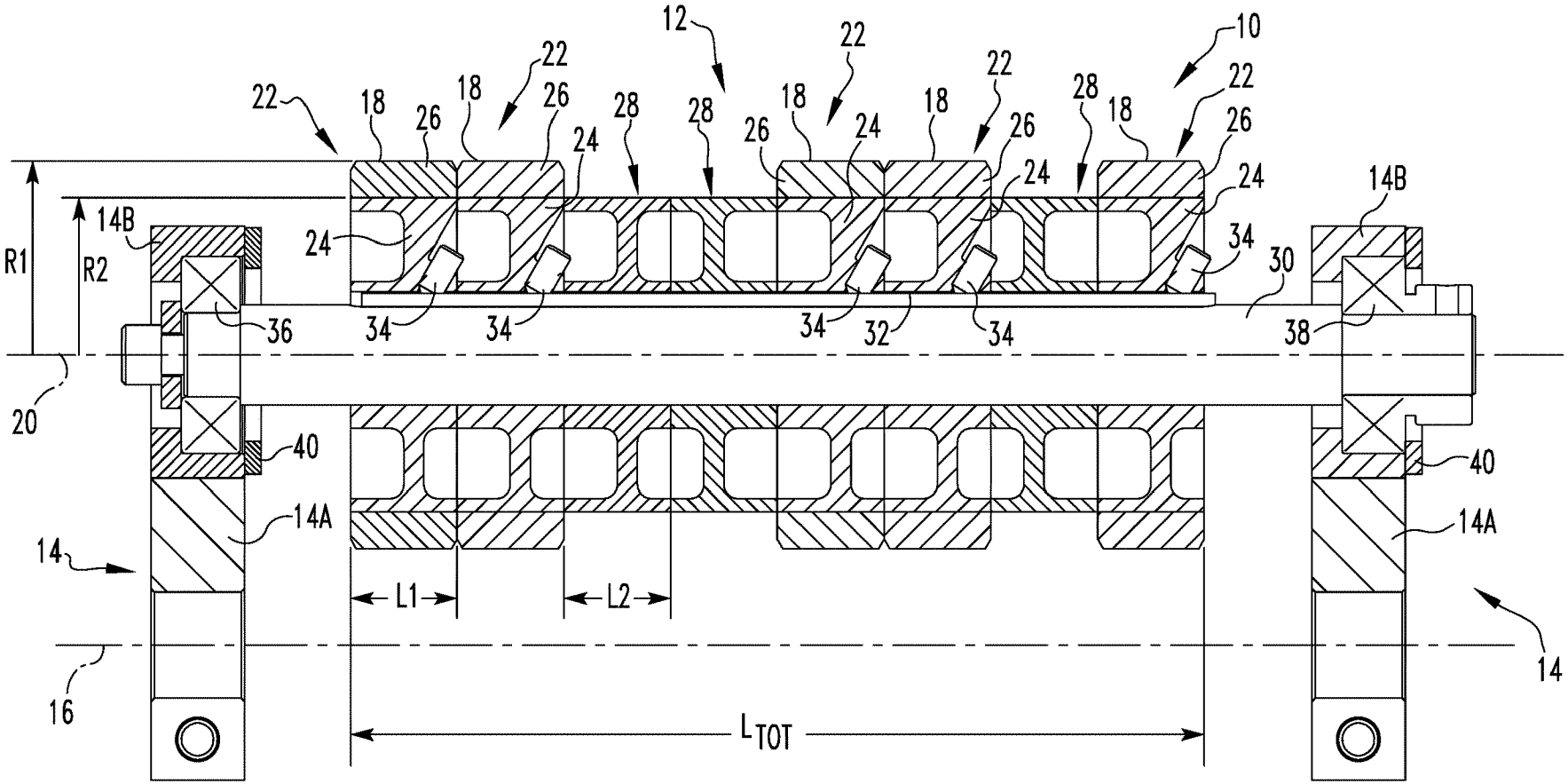
FIG. 5 is a sectional elevation view of the ductor roll assembly of FIG. 4 taken along the central rotational axis of the assembly in the direction indicated by 5-5 in FIG. 4.
Figure 6:
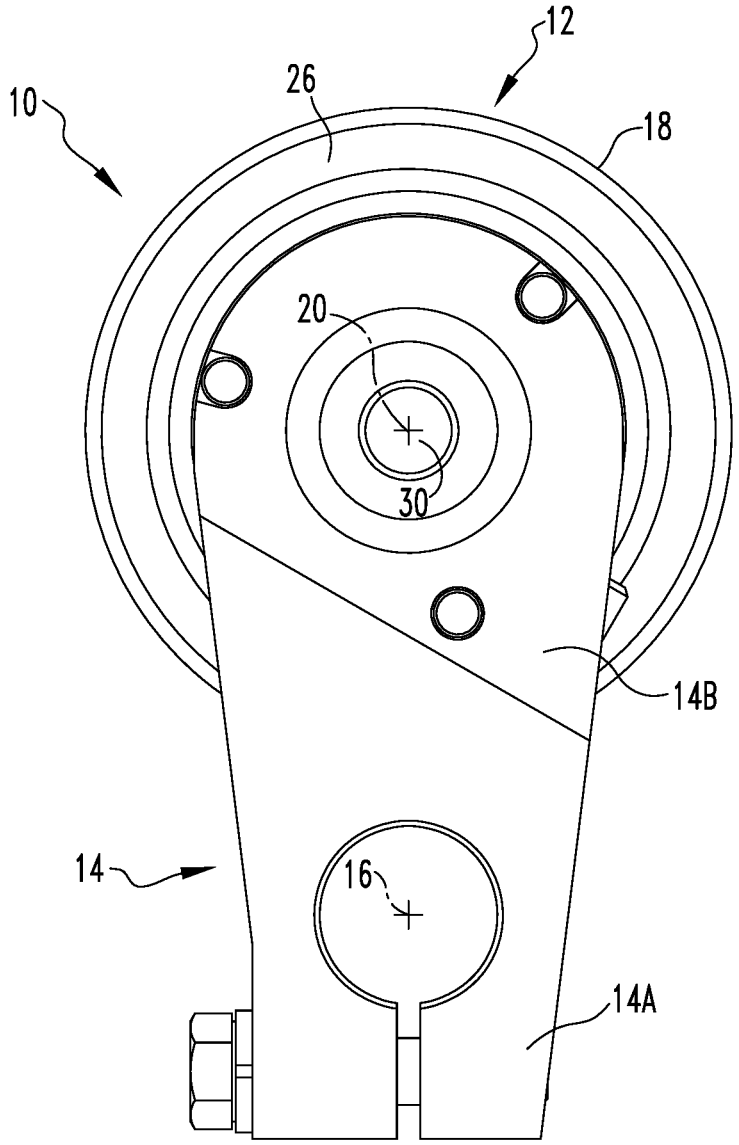
FIG. 6 is an elevation end view of the ductor roll assembly of FIG. 4.

Referring to FIGS. 4-6, a ductor roll assembly 10 in accordance with one example embodiment of the disclosed concept is shown. The ductor roll assembly 10 may be employed, for example, without limitation, in the ink station assembly 200 of the can decorator 100 previously discussed in regard to FIGS. 1-3 in place of the ductor roll 208 and the pivot arms 209. It is to be appreciated, however, that the ductor roll assembly 10 may be used with other ink station assemblies and/or other can decorators for transferring ink from a fountain roll to a distributor roll.

The ductor roll assembly 10 includes a roll portion 12 and a pair of pivot arms 14. The roll portion 12 is coupled to, and between, the pair pivot arms 14. Similar to the pivot arms 209 of the ink station assembly 200 previously discussed, each pivot arm 14 is structured to have a lower portion 14A thereof coupled to a portion of an ink station such as to pivot the roll portion 12 of the ductor roll assembly 10 about a pivot axis 16 between a first position in which the roll portion 12 receives ink from a fountain roll (such as the ink 400 from the fountain roll 204 of FIGS. 2 and 3) and a second position in which the roll portion 12 transfers ink to a distributor roll (such as the distributor roll 206 of FIGS. 2 and 3). In the example shown in FIGS. 4-6, each pivot arm 14 includes an upper portion 14B that is selectively coupled (e.g., via threaded fastener(s) or other suitable arrangement) to the lower portion 14A so as to allow for the upper portion 14B and the roll portion 12 to be removed from an ink station assembly for reconfiguring of the roll portion 12 as discussed further below.

Figure 2:
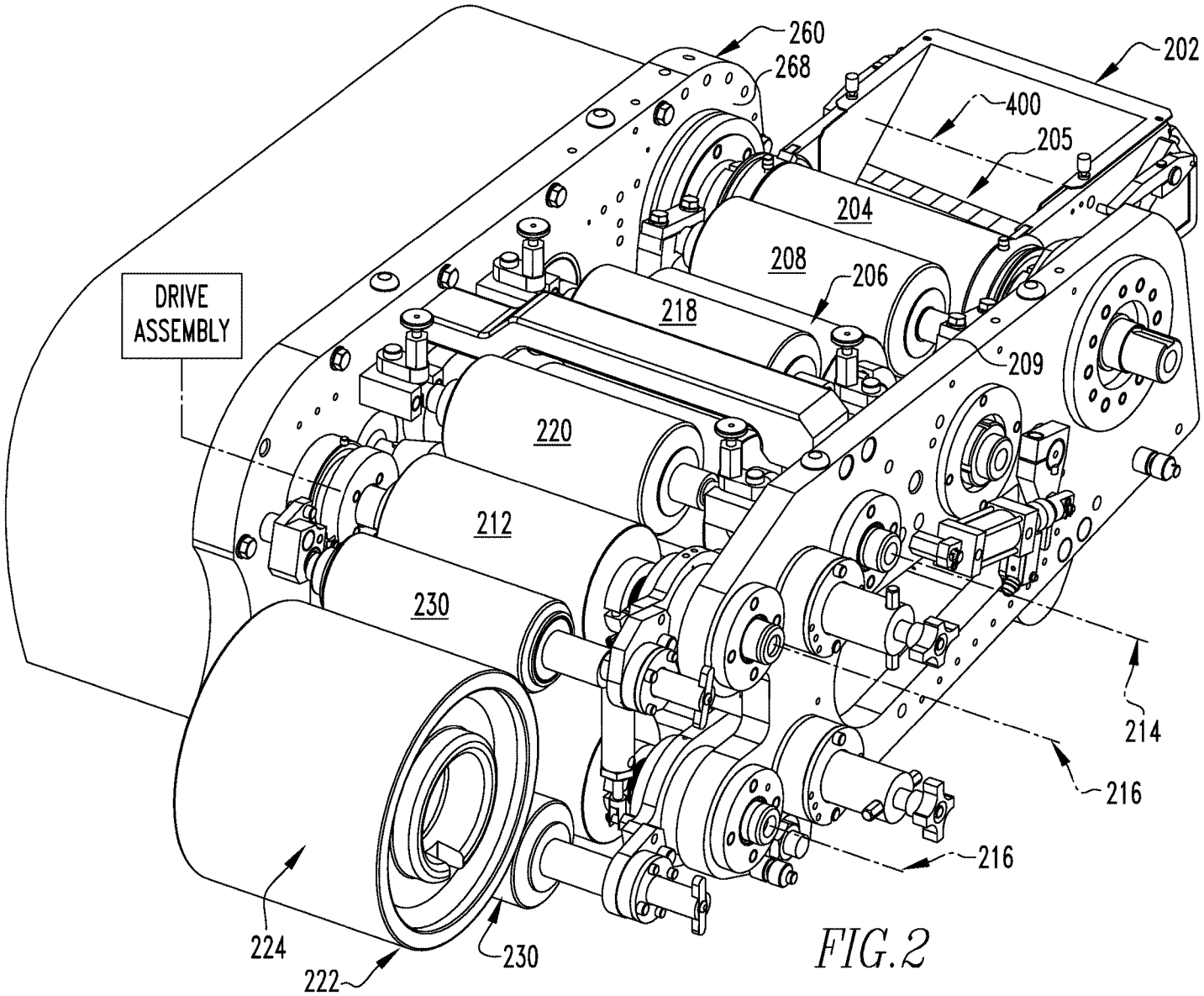
FIG. 2 is an isometric view of one of the ink station assemblies of FIG. 1.

Unlike the ductor roll 208 of the ink station assembly 200 shown in FIGS. 2 and 3 which utilizes a single continuous transfer surface 211 that extends generally between the pivot arms 209 for transferring ink 400, the roll portion 12 of ductor roll assembly 10 includes a plurality of separate transfer surfaces 18 for transferring ink, with each transfer surface having an axial length L1 less than a total length $L_{TOT}$ of the roll portion 12. The plurality of transfer surfaces 18 are positioned in series along the roll portion 12 between the pivot arms 14 and are rotatable with respect to the pivot arms 14 about a rotation axis 20 that is parallel to the pivot axis 16. Each separate transfer surface 18 is radially disposed a first radial distance R1 from the rotation axis 20 and is a portion of a respective transfer segment 22 that is likewise rotatable about the rotation axis 20 (hence the roll portion 12 includes the plurality of the transfer segments 22). In the example embodiment shown in FIGS. 4-6, each transfer segment 22 includes a central hub 24 and an outer portion 26 disposed radially outward from, and coupled to, the central hub 24 that includes the transfer surface 18. In an example embodiment, the central hub 24 is formed from a lightweight material (e.g., without limitation, aluminum) machined so as to minimize rotational inertia, and the outer portion 26 is formed from an NG rubber or other suitable material for receiving and transferring ink. In one example embodiment of the disclosed concept outer portion 26 was formed from an NG rubber having a durometer of 55-60 on the Shore A scale. It is to be appreciated, however, that other suitable materials may be employed without varying from the scope of the disclosed concept.

In addition to the number of transfer segments 22, the roll portion also includes a number of spacer segments 28 disposed in an axial series with the plurality of transfer segments 22. Unlike each transfer segment 22 which has an outer transfer surface 18 for transferring ink, each spacer segment 28 is merely intended to maintain a predetermined axial spacing L2 along the rotation axis 20 and is not structured, or by any means intended, to transfer ink. Accordingly, each spacer segment 28 has an outermost surface (not numbered) that is radially disposed a second radial distance R2 from the rotation axis 20 that is less than the first radial distance R1 so as to not receive or transfer ink from rolls adjacent to the roll portion 12. In the example shown in FIGS. 4-6, each spacer segment 28 is formed from a similar material and of similar dimensions as each central hub 24, however, it is to be appreciated that the material(s) and/or dimension(s) of each spacer segment 28 may be different from the central hub(s) 24 without varying from the scope of the disclosed concept.

In the example shown in FIGS. 4 and 6, each transfer segment 22 and spacer segment 28 is positioned around, and selectively coupled to a central shaft 30 that is centered about the rotation axis 20. As shown in FIG. 4, each transfer segment 22 and spacer segment 28 is rotationally fixed with respect to the central shaft by a key 32 that extends axially along the central shaft 30. Additionally, each transfer segment 22 is axially fixed with respect to the central shaft 30 by a respective setscrew 34 that is threadingly engaged with the central hub 24 of the transfer segment 22 and tightened against the central shaft 30. In such example, each of the spacer segments 28 are axially confined with respect to the central shaft 30 by transfer segments 22 disposed axially adjacent thereto. The central shaft 30 is rotatably coupled at each end thereof to a respective one of the pair of pivot arms 14 by a respective bearing arrangement 36, 38 (e.g., a ball bearing or other suitable arrangement) that is housed in the upper portion 14B of each pivot arm 14 and secured therein by a removable plate 40. Such arrangement provides for the central shaft 30, the transfer segments 22, and the spacer segments 28 to be fixed in regard to each other and rotatable in regard to the pivot arms 14 about the rotation axis 20.

From the foregoing description it is to be appreciated that the roll portion 12 is a modular arrangement of transfer segments 22 and spacer segments 28 that may be readily arranged/configured as desired to provide axial regions that are structured to transfer or to not transfer ink as needed for a particular can decorating application. Depending on the application, the axial lengths L1 and/or L2 of one or both of the transfer segments 22 and/or the spacer segments 28 may be the same as the width of a fountain key regulating the amount of ink passing from an ink fountain to a fountain roll (e.g., such as a fountain key 205 of the ink station assembly of FIG. 2). In the example shown in FIGS. 4-6 each of the axial lengths L1 and L2 are the same as the width of the corresponding fountain keys. Hence, moving left to right in FIG. 5, the roll portion 12 is structured to transfer ink from the first, second, fifth, sixth and eighth fountain keys, while not transferring ink from the third, fourth and seventh fountain keys.

As an alternative to having the axial lengths L1 and/or L2 the same as the width of a fountain key, in applications wherein adjacent segments of the roll portion 12 are the same type of segment (i.e., transfer segments 22 or spacer segments 28), the axial lengths L1 and/or L2 of one or both of the transfer segments 22 and/or the spacer segments 28 may instead be a multiple of the width of a fountain key regulating the amount of ink passing from an ink fountain to a fountain roll as to utilize lesser separate segments. For example, the roll portion 12 of FIG. 5 could alternatively be accomplished using: a first transfer segment having an axial length twice L1 that is structured to transfer ink from the first and second fountain keys; a first spacer segment having an axial length twice L2 that does not transfer ink from the third and fourth fountain keys; another transfer segment having an axial length twice L1 that is structured to transfer ink from the fifth and sixth fountain keys; a second spacer segment having the axial length L2 that does not transfer ink from the seventh fountain key; and a second transfer segment having the axial length L1 that is structured to transfer ink from the eighth fountain key.

Figure 7:
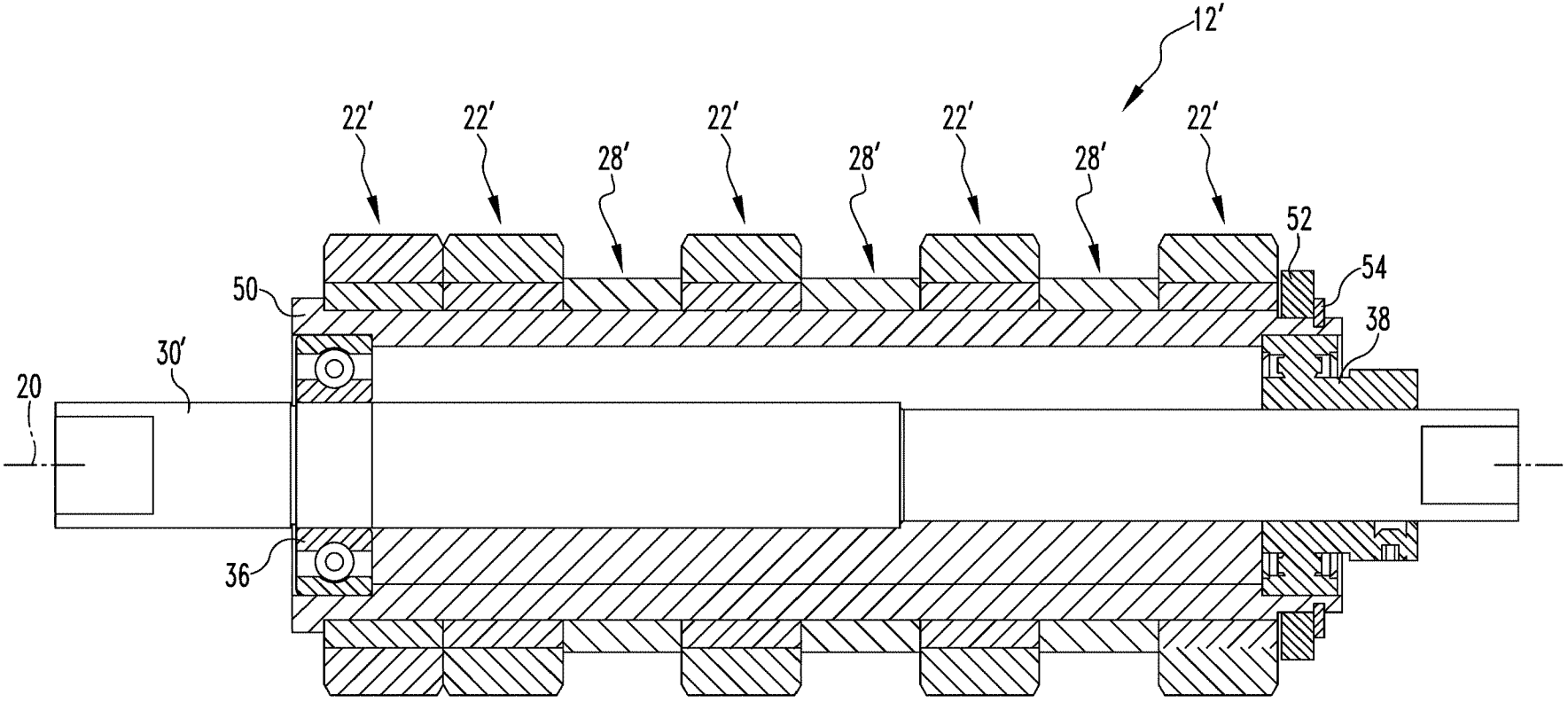
FIG. 7 is a sectional elevation view similar to the view of FIG. 5 of a roll portion of another ductor roll assembly in accordance with another example embodiment of the disclosed concept.
Figure 8:
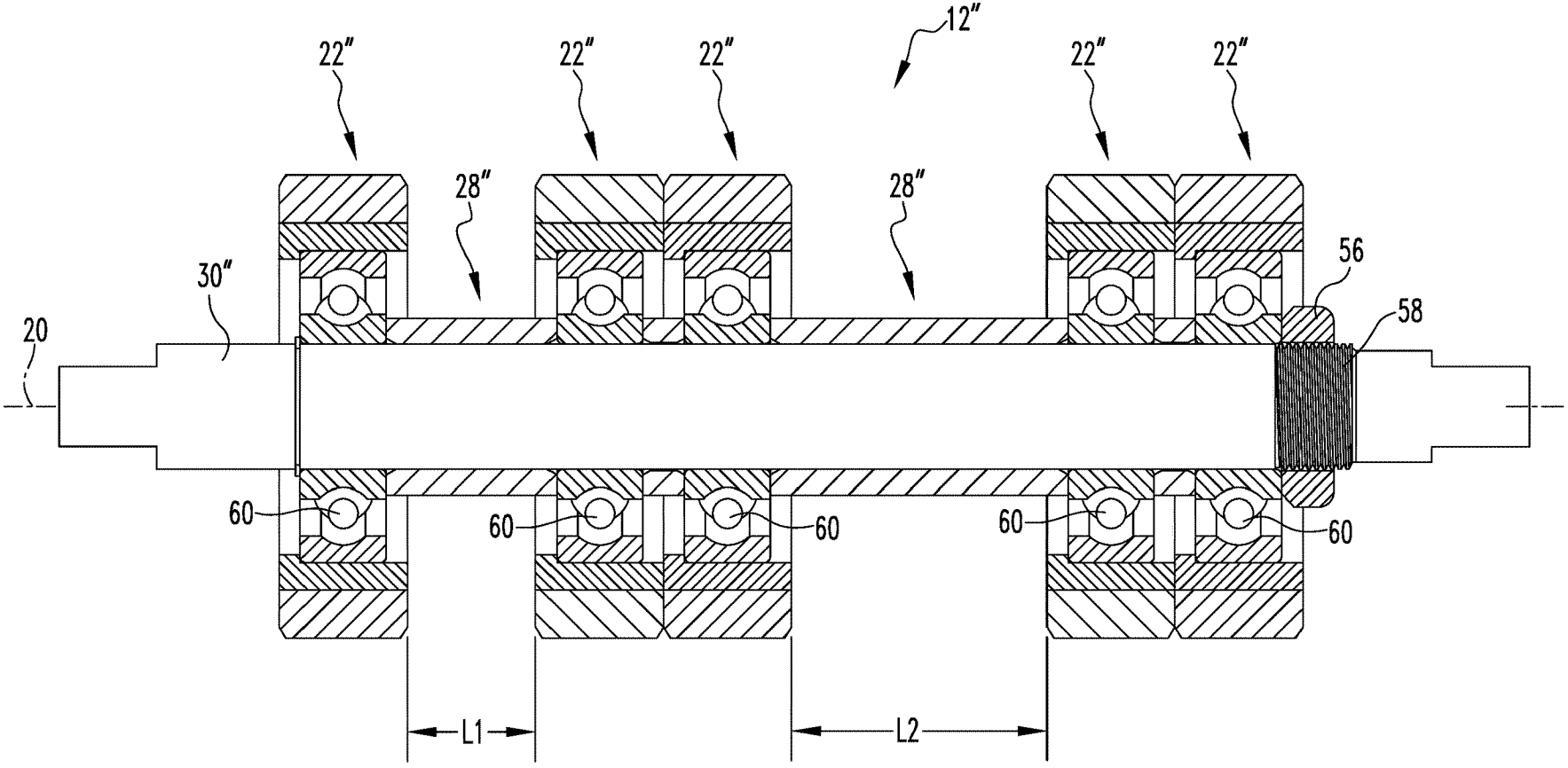
FIG. 8 is a sectional elevation view similar to the views of FIGS. 5 and 7 of yet another roll portion of a ductor roll assembly in accordance with another example embodiment of the disclosed concept.

FIGS. 7 and 8 show sectional views of other example embodiments of roll portions 12' and 12" that provide the same functionality and benefits as roll portion 12 just in a slightly different manner. Referring to FIG. 7, roll portion 12' includes a plurality of transfer segments 22' and spacer segments 28' that function in the same manner as segments 22 and 28 of roll portion 12. However, unlike the example roll portion 12, each of segments 22' and 28' are selectively coupled and arranged in a desired axial sequence on a hollow cylinder 50. The segments 22' and 28' may be readily slid on and off hollow cylinder 50 and secured thereon by a retention ring 52 and lock ring 54 (or via any other suitable arrangement). The hollow cylinder 50 is rotatably coupled to a central shaft 30' via a pair of bearing arrangements 36' and 38', such that the hollow cylinder 50, as well as the segments 22' and 28' coupled thereon, can generally freely rotate about a rotation axis 20 that correspond to a longitudinal axis of the central shaft 30'. Unlike the central shaft 30 of roll portion 12 that rotated with respect to the pivot arms 14 about the rotation axis 20, the central shaft 30' of roll portion 12' is structured to be fixedly coupled to the pivot arms, and thus central shaft 30' does not rotate about rotation axis 30.

Referring to FIG. 8, roll portion 12" includes a plurality of transfer segments 22" and spacer segments 28" that function in the same manner as segments 22 and 28 of roll portion 12, as well as segments 22' and 28' of roll portion 12'. Each of segments 22" and 28" are selectively coupled and arranged in a desired axial sequence on a central shaft 30". The segments 22" and 28" may be readily slid on and off the central shaft 30" and secured thereon by a threaded retention member 56 that threadingly engages a cooperatively threaded portion of central shaft 30". Each of transfer segments 22" are rotatably coupled to the central shaft 30" via a respective bearing arrangement 60 such that each transfer segment 22" can generally freely rotate about the rotation axis 20 that corresponds to a longitudinal axis of the central shaft 30". Like the central shaft 30' of roll portion 12', the central shaft 30" of roll portion 12" is structured to be fixedly coupled to the pivot arms, and thus central shaft 30" does not rotate about rotation axis 30. It is to be appreciated that the example roll portion 12" show in FIG. 8 employs spacer segments 28" of two different axial lengths L1 and L2, and thus further exemplifies a version of the alternative arrangement previously discussed in regard to roll portion 12 of FIGS. 4-6.

From the foregoing examples it is thus to be appreciated that the disclosed concept provides for ductor roll assemblies that address shortcoming of the prior art and that may be readily customized for a particular application or applications, as well as ink station assemblies and can decorators utilizing such ductor roll assemblies that may be originally provided with, or readily retrofit, thereto.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A ductor roll assembly for use in an ink station assembly of a can decorator for communicating ink from a fountain roll to a distributor roll, the ductor roll assembly having a roll portion comprising:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of a fountain roll and a corresponding axial portion of a distributor roll; and a number of spacer segments having a second outer diameter less than the first outer diameter, and wherein the elongated axial member comprises a hollow cylinder that is structured to be positioned around, and rotationally coupled to, a central shaft so as to rotate about the rotation axis.

2. The ductor roll assembly of claim 1, wherein one or both of:

the number of ink transfer segments comprises a plurality of ink transfer segments, and/or the number of spacer segments comprises a plurality of spacer segments.

3. The ductor roll assembly of claim 1, wherein:

the elongated axial member comprises a central shaft that is structured to be rotationally coupled to a pair of pivot arms so as to rotate about the rotation axis, and each segment of the plurality of segments is rotationally fixed with respect to the central shaft.

4. The ductor roll assembly of claim 1, wherein each ink transfer segment comprises a central hub formed form a first material and an outer portion formed from a second material disposed radially outward from, and coupled to, the central hub.

5. The ductor roll assembly of claim 1, wherein:

the elongated axial member comprises a central shaft that is structured to be fixedly coupled to a pair of pivot arms so as to be fixed with respect to the rotation axis, and each ink transfer segment is rotatably coupled to the central shaft so as to be rotatable about the rotation axis.

6. A ductor roll assembly for use in an ink station assembly of a can decorator for communicating ink from a fountain roll to a distributor roll, the ductor roll assembly comprising:

a roll portion comprising:

an elongated axial member; and a plurality of segments selectively disposed on and around the axial member axially adjacent each other for rotation about a rotation axis; and a pair of pivot arms, wherein the roll portion is coupled to, and between the pair of pivot arms, wherein the pair of pivot arms are structured to pivot the roll portion about a pivot axis that is parallel to the rotation axis, wherein the plurality of segments comprises:

a number of ink transfer segments, each ink transfer segment having an ink transfer surface disposed at a first radial distance from the rotation axis and structured to transfer ink between a corresponding axial portion of a fountain roll and a corresponding axial portion of a distributor roll; and a number of spacer segments having a second outer diameter less than the first outer diameter, and wherein:

each pivot arm of the pair of pivot arms comprises an upper portion and a lower portion, the upper portion is coupled to the roll portion, the lower portion is structured to be coupled to an ink station assembly, and the upper portion is selectively coupled to the lower portion so as to provide for the roll portion and the upper portion to be selectively uncoupled from the lower portion.

7. An ink station assembly for use in a can decorator, the ink station assembly comprising:

an ink fountain structured to provide a supply of ink;

a fountain roll disposed adjacent the ink fountain and structured to receive the ink from the ink fountain;

a distributor roll;

a ductor roll assembly having a roll portion pivotable between a first position, adjacent the fountain roll and spaced from the distributor roll, and a second position spaced from the fountain roll and adjacent the distributor roll; and a plurality of adjustable fountain keys positioned side-by-side along an interface between the ink fountain and the fountain roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter, wherein each fountain key is structured to regulate the amount of ink passing from the ink fountain to the fountain roll, wherein each fountain key has a fountain key width that is the same as each of the other fountain keys, and wherein each ink transfer segment has an axial length along the rotation axis that is either the same as, or a multiple of, the fountain key width.

8. The ink station assembly of claim 7, wherein one or both of:

the number of ink transfer segments comprises a plurality of ink transfer segments, and/or the number of spacer segments comprises a plurality of spacer segments.

9. The ink station assembly of claim 7, wherein:

the elongated axial member comprises a central shaft that is structured to be rotationally coupled to a pair of pivot arms so as to rotate about the rotation axis, and each segment of the plurality of segments is rotationally fixed with respect to the central shaft.

10. An ink station assembly for use in a can decorator, the ink station assembly comprising:

an ink fountain structured to provide a supply of ink;

a fountain roll disposed adjacent the ink fountain and structured to receive the ink from the ink fountain;

a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter, and wherein each ink transfer segment comprises a central hub formed from a first material and an outer portion formed from a second material disposed radially outward from, and coupled to, the central hub.

11. An ink station assembly for use in a can decorator, the ink station assembly comprising:

an ink fountain structured to provide a supply of ink;

a fountain roll disposed adjacent the ink fountain and structured to receive the ink from the ink fountain;

a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter, and wherein the elongated axial member comprises a hollow cylinder that is structured to be positioned around, and rotationally coupled to, a central shaft so as to rotate about the rotation axis.

12. An ink station assembly for use in a can decorator, the ink station assembly comprising:

an ink fountain structured to provide a supply of ink;

a fountain roll disposed adjacent the ink fountain and structured to receive the ink from the ink fountain;

a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter, and wherein:

the elongated axial member comprises a central shaft that is structured to be fixedly coupled to a pair of pivot arms so as to be fixed with respect to the rotation axis, and each ink transfer segment is rotatably coupled to the central shaft so as to be rotatable about the rotation axis.

13. An ink station assembly for use in a can decorator, the ink station assembly comprising:

an ink fountain structured to provide a supply of ink;

a fountain roll disposed adjacent the ink fountain and structured to receive the ink from the ink fountain;

a distributor roll; and a ductor roll assembly having a roll portion pivotable between a first position, adjacent the fountain roll and spaced from the distributor roll, and a second position spaced from the fountain roll and adjacent the distributor roll, wherein the fountain roll is structured to transfer ink from the ink fountain to the roll portion of the ductor roll assembly when the roll portion is positioned in the first position, wherein the roll portion of the ductor roll assembly is structured to transfer ink from the roll portion to the distributor roll when the roll portion is positioned in the second position, wherein the roll portion comprises:

an elongated axial member; and a plurality of segments selectively disposed on and around the axial member axially adjacent each other for rotation about a rotation axis, wherein the plurality of segments comprises:

a number of ink transfer segments, each ink transfer segment having an ink transfer surface disposed at a first radial distance from the rotation axis and structured to transfer ink between a corresponding axial portion of the fountain roll and a corresponding axial portion of the distributor roll; and a number of spacer segments having a second outer diameter less than the first outer diameter, and wherein:

the ductor roll assembly further comprises a pair of pivot arms for pivoting the roll portion between the first position and the second position, the roll portion is coupled to, and between the pair of pivot arms, the pair of pivot arms are structured to pivot the roll portion about a pivot axis that is parallel to the rotation axis, each pivot arm of the pair of pivot arms comprises an upper portion and a lower portion, the upper portion is coupled to the roll portion, the lower portion is coupled to another portion of the ink station assembly, and the upper portion is selectively coupled to the lower portion so as to provide for the roll portion and the upper portion to be selectively uncoupled from the lower portion.

* * * * *